US009669535B2

(12) United States Patent
Yaschur et al.

(10) Patent No.: US 9,669,535 B2
(45) Date of Patent: Jun. 6, 2017

(54) POWER TOOL HOUSING CONSTRUCTION

(71) Applicant: Ingersoll-Rand Company, Davidson, NC (US)

(72) Inventors: Jefferey Clifford Yaschur, Doylestown, PA (US); Sean Christian Ely, Flemington, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 608 days.

(21) Appl. No.: 14/011,418

(22) Filed: Aug. 27, 2013

(65) Prior Publication Data

US 2014/0054055 A1 Feb. 27, 2014

Related U.S. Application Data

(60) Provisional application No. 61/693,635, filed on Aug. 27, 2012, provisional application No. 61/694,062, filed on Aug. 28, 2012.

(51) Int. Cl.

| | |
|---|---|
| ***B25F 5/02*** | (2006.01) |
| ***B25B 21/00*** | (2006.01) |
| ***B25B 13/46*** | (2006.01) |

(52) U.S. Cl.

CPC ..... *B25F 5/02* (2013.01); *B25B 13/461* (2013.01); *B25B 21/00* (2013.01); *B25B 21/004* (2013.01)

(58) Field of Classification Search

CPC ..... B25B 13/461; B25B 21/00; B25B 21/004; B25F 5/02; B25D 17/043; B23B 45/001; Y10T 16/4713

USPC ..... 173/104, 221, 217, 47; 81/57.39; 285/334.2

See application file for complete search history.

(56) References Cited

U.S. PATENT DOCUMENTS

| | | | | |
|---|---|---|---|---|
| 3,443,646 | A * | 5/1969 | Baker | B25B 21/00 173/169 |
| 4,368,904 | A * | 1/1983 | Lanz | F16L 25/0045 285/149.1 |
| 4,573,370 | A * | 3/1986 | Clemens | B25B 21/00 173/218 |
| 4,682,918 | A * | 7/1987 | Palm | B23B 31/123 279/60 |
| 4,919,462 | A * | 4/1990 | Matsui | H02G 3/0691 285/125.1 |
| 4,974,475 | A | 12/1990 | Lord et al. | |
| 5,142,952 | A | 9/1992 | Putney et al. | |

(Continued)

OTHER PUBLICATIONS

International Search Report for International PCT Application No. PCT/US13/56855 dated Jan. 10, 2014 (2 pages).

(Continued)

*Primary Examiner* — Hemant M Desai
*Assistant Examiner* — Valentin Neacsu
(74) *Attorney, Agent, or Firm* — Taft Stettinius & Hollister LLP

(57) ABSTRACT

An apparatus is disclosed including a motor housing structured to receive at least a portion of an electric motor, a tool housing including a first half and a second half, wherein the tool housing defines an end taper, a tool attachment in mechanical communication with the electric motor, and a retention member including an inner taper structured to interface with the end taper of the tool housing to resist relative motion between the tool housing and the motor housing.

17 Claims, 2 Drawing Sheets

(56) References Cited

U.S. PATENT DOCUMENTS 5,251,706 A * 10/1993 Evans ..... B25B 13/46 173/217
6,915,721 B2 7/2005 Hsu et al.
7,207,394 B2 4/2007 Young et al.
7,475,609 B2 1/2009 Liaw
7,604,528 B2 10/2009 Lo et al.
7,735,398 B2 6/2010 Hsu et al.
7,752,760 B2 * 7/2010 Baskar ..... A01G 3/053 30/210
2002/0043136 A1 * 4/2002 Ladish ..... B25B 23/0064 81/429
2002/0139547 A1 * 10/2002 Nowak, Jr. ..... B25F 5/00 173/1
2003/0121676 A1 * 7/2003 Ortt ..... B25F 5/02 173/1
2003/0159843 A1 8/2003 Sakai
2004/0093969 A1 * 5/2004 Nielsen ..... A47C 20/041 74/89.23
2004/0148789 A1 * 8/2004 Gist ..... B23D 49/11 30/392
2005/0090216 A1 * 4/2005 Hsu ..... B25B 21/004 455/184.1
2007/0056759 A1 3/2007 Aeberhard
2007/0256847 A1 11/2007 Wan et al.
2008/0025017 A1 1/2008 Tadokoro et al.
2008/0190246 A1 * 8/2008 Hsu ..... B25B 23/147 81/57.13
2009/0014194 A1 * 1/2009 Sakai ..... B25B 21/02 173/93
2009/0221222 A1 * 9/2009 Lo ..... B25F 5/008 451/359
2009/0322166 A1 * 12/2009 Satterfield ..... B25F 5/02 310/50
2010/0326243 A1 * 12/2010 Bouchard ..... B25B 21/004 81/57
2011/0110734 A1 5/2011 Scrimshaw et al.
2011/0126676 A1 6/2011 Chaing

OTHER PUBLICATIONS

Written Opinion of the International Searching Authority for International PCT Application No. PCT/US13/56855 dated Jan. 10, 2014 (6 pages).

* cited by examiner

POWER TOOL HOUSING CONSTRUCTION

CROSS-REFERENCE

The present application claims the benefit of U.S. Provisional Patent Application No. 61/693,635 filed on Aug. 27, 2012, and the benefit of U.S. Provisional Patent Application No. 61/694,062, filed on Aug. 28, 2012, both of which are hereby incorporated by reference in their entirety.

FIELD OF THE INVENTION

The present invention generally relates to power tools, and more particularly, but not exclusively, to a housing construction for an electrically driven power tool.

BACKGROUND OF THE INVENTION

Hand-held power tool housing construction remains an area of interest. Many current electrically driven power tool housings fail to provide adequate strength. Some current designs provide for a one-piece tubular housing to bolster strength; however, this design may not lend itself well to battery powered tools due to various complexities involved in assembling the electronic components therein. Therefore, further technological developments are desirable in this area.

BRIEF SUMMARY OF THE INVENTION

One embodiment of the present invention is a housing construction for a power tool. Other embodiments include apparatuses, systems, devices, hardware, methods, and combinations for providing a unique housing for an electrically driven power tool that includes a split housing, a substructure, and a reinforcing superstructure. Further embodiments, forms, features, aspects, benefits, and advantages of the present application shall become apparent from the description and figures provided herewith.

BRIEF DESCRIPTION OF THE SEVERAL VIEWS OF THE DRAWINGS

The description herein makes reference to the accompanying figures wherein like reference numerals refer to like parts throughout the several views, and wherein.

DETAILED DESCRIPTION OF THE INVENTION

Figures 1A, 1B:
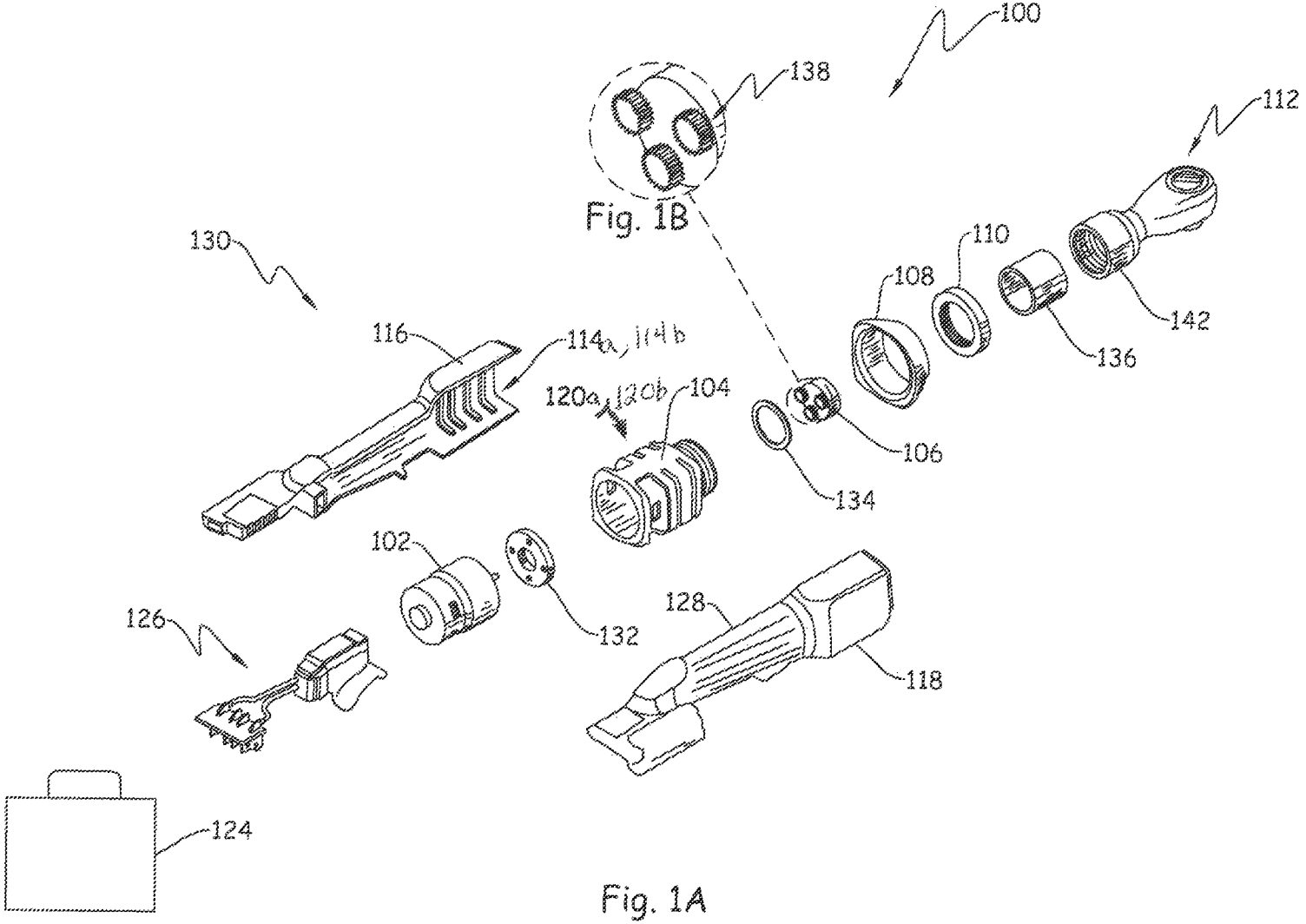
FIG. 1A is an exploded perspective view of one embodiment of a power tool housing.
FIG. 1B is an exploded view of one form of a gear assembly.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1A illustrates one embodiment of a power tool assembly 100. The power tool assembly 100 includes a tool housing 130, a substructure 104, a gear assembly 106, a superstructure 108, and a tool head 112. The tool housing 130, substructure 104, and superstructure 108 include a variety of unique features to strengthen the power tool assembly 100.

The tool housing 130 can be divided into two portions, for example, a first half 116 and a second half 118 as shown. The first and second halves 116, 118 can be coupled to form the tool housing 130. In one form, the first and second halves 116, 118 are joined in a manner such that a clamshell style tool housing 130 is formed. The tool housing 130 can be constructed from a variety of materials including various composites, polymers, or any other material suitable for the construction of the tool housing 130, which can be determined based upon for example a force to be applied to the tool housing 130.

In the illustrated embodiment, a plurality of ribs 114*a* extend from an inner surface of the tool housing 130. As shown, the first half 116 and the second half 118 can each include a plurality of radially inwardly extending ribs 114*a* and recessed grooves 114*b*. The radially inwardly extending ribs 114*a* need not encircle the full interior of the tool housing 130. The substructure 104 includes a plurality of ribs and grooves 120*a*, 120*b* respectively that are sized to receive the ribs and grooves 114*a*, 114*b* extending from the inner surface of the tool housing 130. In some forms, the substructure 104 can additionally and/or alternatively include a plurality of ribs 120*a* which interlock between the plurality of ribs 114*a* extending from the inner surface of the tool housing 130. When the first and second halves 116, 118 of the tool housing 130 are assembled together, the ribs 114*a* of the tool housing 130 mate with the grooves 120*b* of substructure 104 to prevent or resist relative axial movement between the tool housing 130 and the substructure 104. It is contemplated that the substructure 104 and the tool housing 130 can be configured to mate in a variety of fashions, through protrusions received in grooves, through an extension disposed in a channel, or any other type of configuration such that the tool housing 130 and the substructure 104 interlock to resist axial movement relative to each other.

The substructure 104 receives at least a portion of the motor 102 in an inner cavity of the substructure 104. The substructure 104 can be substantially tubular in shape; however, any shape may be utilized such that the substructure 104 can mate with the tool housing 130 and can at least partially house the motor 102. In one form, the substructure 104 can fully encompass the motor 102. The substructure 104 can be constructed of various metals, such as steel or the like, and can be constructed through various processes, including, but not limited to casting or progressive die forming. In one form, the substructure 104 is constructed of one or more materials that are stronger than the materials from which the tool housing 130 is constructed.

The motor 102 is an electrically powered motor. The motor 102 can take any configuration such that the motor 102 converts electrical energy into mechanical energy. This mechanical energy can be transferred through a gear assembly 106, and other assemblies, to drive a tool head 112. The motor 102 can be at least partially retained by a motor retainer 132 or the like. The motor retainer 132 can aid in the prevention of rotation of the motor 102 relative the substructure 104.

The motor 102 can be in electrical communication with a battery pack 124 through a wiring harness and motor controller 126. The battery pack 124 can be semi-permanently affixed to the power tool assembly 100 such that the entire power tool assembly is placed in a charger or has a charger coupled thereto, or the battery pack 124 can be removable from the power tool assembly 100 to allow for quick battery changes and charging at a remote charging station.

Referring more closely to FIGS. 1A and 1B, a motor 102 output can be placed in mechanical connection with a gear assembly 106 comprising a plurality of gears 138. In one form, a ring gear stop 134 resists axial movement of a ring gear housing 136 and therefore axial movement of the gear assembly 106. While the mechanical connection between the motor 102 output and the tool head 112 has been illustrated in the form of a ring gear housing 136 including a gear assembly 106, the application is not intended to be limited thereto. It is contemplated that any mechanical connection, including a direct connection, may be utilized to transfer power from the electric motor 102 to the tool head 112.

The tool head 112 provides an output for a tool bit, socket, or the like. The tool head 112 is illustrated as a ratchet in FIG. 1A. The tool head 112 can be utilized to tighten and loosen a variety of threaded fasteners, such as nuts, bolt heads, or the like. The tool head 112 can be coupled to the power tool assembly in a variety of manners, such as through a tool head fastener 142.

The tool assembly 100 can be operated in both a powered mode and in a manually-operated mode. In a powered mode, an operator holds a tool grip 128 while the tool head 112 delivers torque to a fastener, using the mechanical power that the electric motor 102 has delivered. In the manually-operated mode, the operator manipulates the tool grip 128 like a socket wrench, applying force to the handle, and using the power tool assembly 100 as a moment arm for creating and delivering torque to the fastener. In some forms, various motor 102 and gearing 106 configurations can be utilized to switch between the manual and powered mode.

Figure 2:
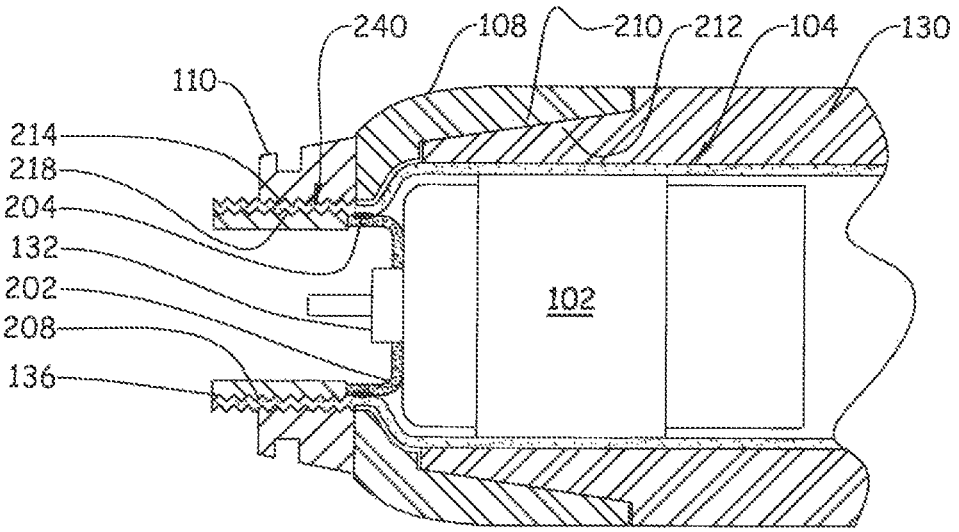
FIG. 2 is a cross sectional view of one embodiment of power tool housing.

The superstructure 108 and the tool housing 130 include respective tapers 210 and 212. The taper 210 of the superstructure 108 applies a force against the taper 212 of the tool housing 130 to retain the first and second housing portions 116, 118 together and to resist or prevent movement of the tool housing 130 relative to the substructure 104. As described in greater detail below, a suitable nut 110 can be used to compress the taper 210 of the superstructure 108 against the taper 212 of the tool housing 130. FIG. 2 shows one example of the taper 212 of the tool housing 130 in relation to the taper 210 of the superstructure 108. The taper 210 of the superstructure 108 can take any form such that it is operable to apply a radially inward force to the taper 212 of the tool housing 130. The superstructure 108 can include a clamp ring, a snap ring, or any other structure that includes a taper 210 that is suitable to exert a radially inward force on a taper 212 of the tool housing 130. The superstructure 108 can be constructed of various materials, including metals such as aluminum or steel, that exhibit a greater material strength than a material strength of the tool housing 130. In a specific form, the superstructure 108 can be formed through a casting process, such as die casting.

In the illustrated embodiment, the substructure 104 has a threaded projecting portion 214. The nut 110 has corresponding threads 240 and can be fastened to the substructure projecting portion 214 such that, when tightened, the nut 110 exerts an axial force upon the superstructure 108. The taper 210 of the superstructure 108, in turn, exerts an axial and radial force upon the taper 212 of the tool housing 130. The radial force on the tool housing 130 radially clamps, that is compresses, the first and second halves 116, 118 of the tool housing 130 together, preventing or resisting the first and second halves 116, 118 from coming apart. In one form, where mating ribs/grooves 114*a*, 114*b* and ribs/grooves 120*a*, 120*b* respectively are present, the axial force on the tool housing 130 is transmitted to the ribs/grooves 114*a*, 114*b* to axially urge the ribs/grooves 114*a*, 114*b* against the ribs/grooves 120*a*, 120*b* with which they mate to prevent or resist axial movement of the tool housing 130 relative to the substructure 104.

Referring again to FIG. 2, in one form a ring gear stop 202 is attached to the substructure 104. The ring gear stop 202 can be connected to the substructure 104 such as through a weld 204 or the like. The ring gear housing 136 can include a plurality of outer threads 208 which are received by a plurality of inner threads 218 of the substructure 104. The ring gear housing 136 can be threaded such that it abuts the ring gear stop 202.

Figure 3:
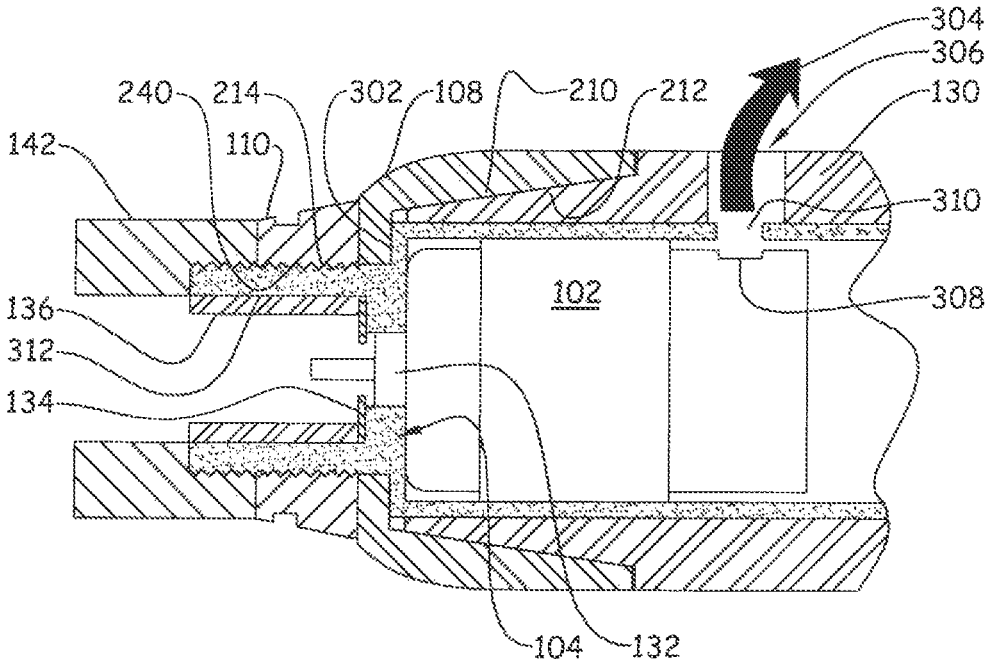
FIG. 3 is a cross sectional view of yet another embodiment of a power tool housing.

Referring now to FIG. 3, in some forms, the tool head fastener 142 can be directly fastened to the tool substructure 104 such as through tool head fastener threads 312. In this form, the ring gear housing 136 is placed in an abutting relationship 312 with the substructure 104. Additionally, various portions 302 can be formed integrally with the substructure 104 rather than being welded or attached, as was described with reference to FIG. 2. Although specific illustrative examples have been given, as was previously aforementioned, it is contemplated that the tool head 112 is mechanically interconnected to the electric motor 102 in any suitable manner such that the electric motor 102 can transfer power to the tool head 112.

The electric motor 102 can generate heat during use. To evacuate this heat, exhaust vents 308 can be disposed in the motor 102. A vent 310 can additionally be located in the substructure 104 and a vent 306 can be located in the tool housing 130 allowing heated air 304 to exit from the motor 102. As is illustrated, the vents 308, 310, 306 can be axially and radially aligned such that air can flow directly radially outward. In some forms, this will allow a user to view the vent 308 of the motor 102 through the vent 306 in the tool housing 130. In further forms, multiple flowpaths can be disposed in the motor 102, the tool housing 130, and the substructure 104 to provide for both an inlet air flow and an exhaust air flow. For example, the tool housing 130 can include a first flowpath in fluid communication with a second flowpath located in the motor 102, and the second flowpath can be in fluid communication with the intake and or the exhaust of the motor 102. The first flowpath can be at least partially radially aligned with the second flowpath, and the second flowpath can be at least partially radially aligned with the intake and/or exhaust of the motor 102. Any number of airflow paths are contemplated to provide cooling to the motor 102.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A system, comprising:

a single piece substructure including an inner surface that defines an inner cavity structured to receive an electric motor therein;

a tool housing including coupled first and second halves that define an inner portion;

a superstructure including an inner taper that interfaces with an outer taper of the first and second halves of the tool housing, the superstructure being configured to prevent or resist radially outward movement of the first and second halves of the tool housing from the substructure;

a rib extending from one of either the inner portion of the tool housing and an outer surface of the substructure, and a channel located in the other of the inner portion of the tool housing and the outer surface of the substructure; and wherein the substructure is received by the inner portion of the tool housing such that the rib resides in the channel, the rib and channel being configured to prevent or resist relative axial movement between the tool housing and the substructure.

2. The system of claim 1, wherein the substructure includes an axially extending threaded portion and the system further comprises a nut threaded to the threaded portion to compress the inner taper against the outer taper.

3. The system of claim 1, comprising a tool head in mechanical communication with an output of the electric motor.

4. The system of claim 3, wherein the motor and tool head are configured to selectively operate in an electrically powered mode and a manually powered mode.

5. The system of claim 1, wherein the substructure comprises a first material and the tool housing comprises a second material, the first material having a metal portion.

6. The system of claim 1, wherein the electric motor includes a first vent aligning with a second vent located in the substructure, and wherein the second vent further aligns with a third vent located in the tool housing.

7. An apparatus, comprising:

a single piece motor housing structured to receive at least a portion of an electric motor therein;

a tool housing including a first half and a second half, wherein the tool housing defines an end taper;

a tool attachment in mechanical communication with the electric motor;

a retention member including an inner taper structured to interface with the end taper of the tool housing, the retention member being configured to prevent or resist relative motion between the tool housing and the motor housing; and wherein the tool housing includes a radially inwardly extending protrusion received in a radially extending groove located in an outer surface of the motor housing, the protrusion and groove being configured to resist or prevent relative axial movement between the tool housing and the motor housing.

8. The apparatus of claim 7, further including a threaded portion located on a first end of the motor housing, wherein at least a portion of the first end of the motor housing extends axially outside of the tool housing; and a nut threaded to the threaded portion to apply an axial force to the retention member such that the inner taper of the retention member such that the inner taper of the retention member is pressed against the end taper of the tool housing.

9. The apparatus of claim 7, wherein the tool housing includes a first plurality of radially inwardly extending protrusions;

the motor housing includes a second plurality of radially outwardly extending protrusions; and wherein the first plurality of protrusions mate with the second plurality of protrusions to resist or prevent relative axial movement between the tool housing and the motor housing.

10. The apparatus of claim 7, wherein the tool attachment further includes a ratchet.

11. The apparatus of claim 7, wherein the tool housing further includes a first flowpath in fluid communication with a second flowpath located in the motor housing, and wherein the second flowpath is in fluid communication with at least one of an intake and an exhaust of the electric motor.

12. The apparatus of claim 11, wherein the first flowpath is at least partially radially aligned with the second flowpath, and the second flowpath is at least partially radially aligned with the at least one of the intake and the exhaust of the electric motor.

13. The apparatus of claim 7, wherein at least one of a motor housing material and a retention member material includes a metal material.

14. An apparatus, including:

a single piece inner casing at least partially enclosing an electric motor, the electric motor in selective electric communication with a battery;

a tool output in mechanical communication with the electric motor;

a split outer casing structured to receive at least a portion of the inner casing within a cavity defined by the split outer casing; and a clamp having an inner taper configured to press against an outer taper of the split outer casing, the clamp being configured to retain the split outer casing relative to the inner casing; and a rib extending from one of either the cavity wall of the split outer casing and an outer portion of the inner casing, and a groove located in the other one of the cavity wall of the split outer casing and the outer portion of the inner casing, wherein the rib is disposed within the groove, the rib and groove being configured to prevent or resist relative axial movement between the inner casing and the split outer casing.

15. The apparatus of claim 14, wherein the tool output includes a ratchet.

16. The apparatus of claim 14, further including a plurality of threads located near a first end of the inner casing, wherein a threaded fastener is threaded on the plurality of threads to apply an axial force to the clamp such that the inner taper is pressed against the outer taper.

17. The apparatus of claim 14, wherein the inner casing and the split outer casing further include an air flowpath therethrough, wherein the air flowpath is in fluid communication with at least one of an air intake and an air exhaust located in the electric motor.

* * * * *